United States Patent [19]

Casey

[11] Patent Number: 4,510,904

[45] Date of Patent: Apr. 16, 1985

[54] VACUUM OPERATED IDLE SPEED CONTROL DEVICE

[75] Inventor: Gary L. Casey, Troy, Mich.

[73] Assignee: Allied Corporation, Morristown, N.J.

[21] Appl. No.: 638,188

[22] Filed: Aug. 6, 1984

[51] Int. Cl.[3] ..... F02D 11/08

[52] U.S. Cl. ..... 123/339; 123/587

[58] Field of Search ..... 123/339, 585, 587

[56] References Cited

U.S. PATENT DOCUMENTS

| | | | |
|---|---|---|---|
| 3,661,131 | 5/1972 | Croft | 123/339 |
| 3,930,479 | 1/1976 | Stumpp | 123/585 |
| 4,425,887 | 1/1984 | Knapp et al. | 123/339 |

FOREIGN PATENT DOCUMENTS

| | | | |
|---|---|---|---|
| 2940237 | 4/1981 | Fed. Rep. of Germany | 123/339 |

*Primary Examiner*—Tony M. Argenbright

*Attorney, Agent, or Firm*—R. C. Wells

[57] ABSTRACT

A vacuum operated idle speed control device (26) for use on internal combustion engines to regulate the idle speed of the engine at the lowest operating speed. A controlled or sized input orifice (48) to the device (26) permits the basic valve body (38) to be used on different engine sizes. The diaphragm (42) modulates under control of an electromechanical vacuum control valve to provide the correct amount of pressure opening and closing the device (26). The vacuum operated idle speed control device (26) may include the vacuum control valve as an integral component.

4 Claims, 7 Drawing Figures

VACUUM OPERATED IDLE SPEED CONTROL DEVICE

This invention relates to a vacuum operated idle speed control system in general and in particular to a vacuum operated idle speed control device.

Idle speed control devices are used in motor vehicles to keep the internal combustion engine from stalling during low speeds, particularly in the idle range. This is accomplished by bypassing the throttle valve in the throttle body and feeding air directly into the intake manifold, thereby having the fuel mixture with the ratio that is combustible. This will then maintain the engine running at a particular speed depending on the amount of fuel being supplied.

In the prior art, this is accomplished by means of electronic or electromechanical control devices controlling the operation of the idle speed valve. Most operate from speed sensing and then maintain a fixed speed and do not attempt to find the lowest operating speed possible. By operating at the lowest operating speed at idle, not only are emissions controlled but also fuel economy is improved inasmuch as it takes less fuel to run a slower engine. Most prior art devices sense the operating speed of the engine and when it is reduced to the idle speed range which is approximately 650 to 700 rpm, the idle speed control device operates to maintain the engine at that speed. Depending upon the loads in the engine, it is possible under certain conditions to operate the engine at an idle speed which is 550 to 600 rpm. However, the prior art devices and systems are not able to operate at these conditions.

Some of the more advanced prior art systems use a complicated stepping motor operating a control valve in steps to decrease or increase the amount of bypass air being used. Such devices are large, bulky and have a slow response time as the stepping motor is stepped through its several steps. Inasmuch as the control is keyed in on a predetermined speed, the operating speed of the engine must be sensed after each step and applied to a control circuitry to control the stepping of the motor.

It is a main object of the invention to operate an internal combustion engine at the lowest idle speed possible. It is a further object of the invention to provide an idle speed device adaptable to be used on all engine sizes within an engine family by only changing one element on the device.

These and other objects of the invention will become apparent from the following detailed description taken in connection with the drawings in which.

DETAILED DESCRIPTION

Figure 1:
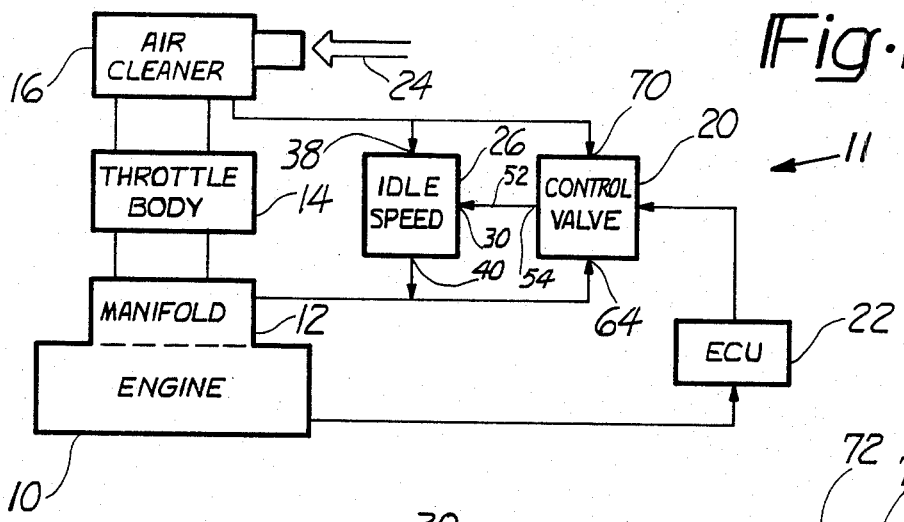
FIG. 1 is a block diagram of a idle speed control system using the present invention.

Referring to the figures by their characters of reference, FIG. 1 illustrates a block diagram of an idle speed control system 11 utilizing a vacuum operated idle speed control device 26 of the present invention. The system comprises an engine 10, an intake manifold 12, a throttle body 14, an air cleaner 16, a vacuum operated idle speed control device 26, a control valve 20, and an electronic control unit or ECU 22. In FIG. 1 only the lines going to and coming from the ECU 22 are nonpneumatic lines and in most instances are electronic control signals. Each of the other interconnecting lines indicate the routing of various pneumatic signals.

Ambient air for operating the engine, illustrated by the arrow 24, is received through the air cleaner 16 removing the dirt and other foreign particles prior to being supplied to the engine 10. This clean air is also supplied to the idle speed control device 26 and the control valve 20. Clean air is also passed through a throttle body 14 or a carburetor under the control of a choke valve or a throttle valve, both of which are not shown, into the intake manifold 12 of an engine 10. Fuel is supplied to the engine 10 through the throttle body 14, the carburetor or in a conventional manner by a multipoint electronic fuel injection system.

The vacuum operated idle speed control device or idle speed control device 26 receives the clean air from the air cleaner 16 and under the control of the control valve 20 supplies air into the intake manifold 12 in a bypass manner around the throttle valve or the choke valve in the throttle body 14. As will hereinafter be shown, the control valve 20 will receive vacuum signals from the intake manifold 12 and air from the air cleaner 16 and supply a mixture of the air and the intake manifold vacuum to the idle speed control device 26. The control valve 20 as illustrated in FIG. 1 may take the shape of many different control valves 20, one of which is simplistically illustrated in FIG. 4 or such a valve may be that found in U.S. patent application Ser. No. 481,126, filed Apr. 1, 1983, now abandoned, by Mulder and entitled "Electric Vacuum Regulator" and is incorporated herein by reference. For the purposes of illustration, the control valve 20 is a electromagnetic valve that is under the control of an ECU 22 receiving signals from the engine 10 indicating particular engine operating conditions. The present system operates both at the idle speed range and during decelerations from one engine speed to another to effectively control emissions discharged by the engine 10. Such an ECU 22 may be one that controls all engine operating conditions such as ignition, fueld injection, etc., or may be a simple ECU responding to certain engine parameters to merely control the idle speed control device 26.

Figure 2:
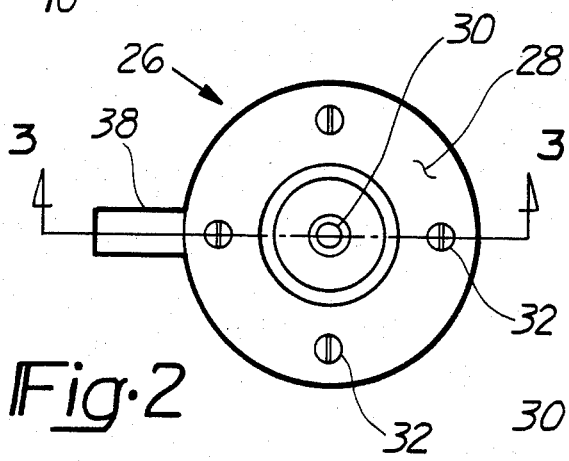
FIG. 2 is a plan view of the preferred embodiment of the vacuum operated idle speed control device.

The plan view of a vacuum operated idle speed control device 26 according to the present invention, illustrated in FIG. 2 shows a top or cover member 28 having a first port 30 for receiving a control signal from the control valve 20. Additionally shown are a plurality of fastening means 32 such as screws indicating that the device is fabricated in at least two sections and joined together.

Figure 3:
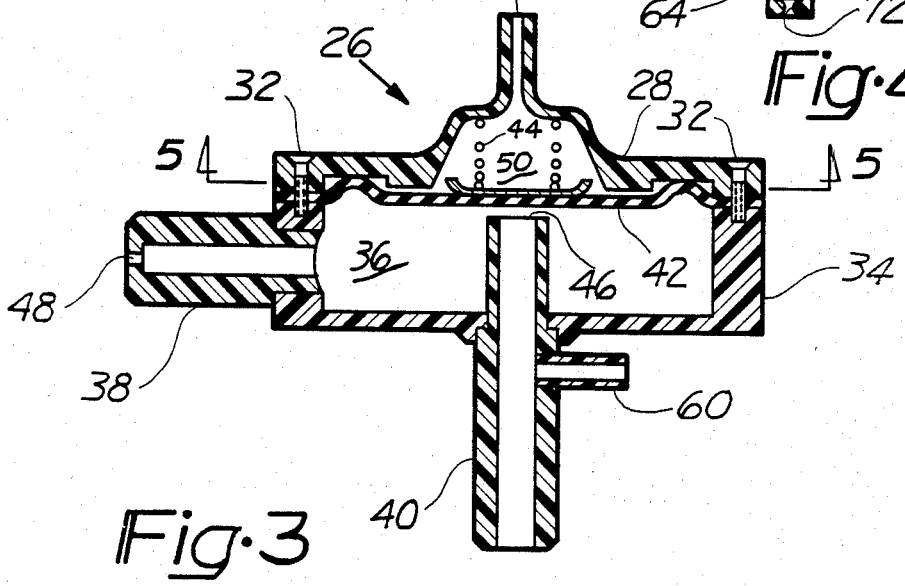
FIG. 3 is a sectional view taken along the line 3—3 of FIG. 2.

Referring to FIG. 3, a cross-sectional view of the idle speed control device 26 showing the top or cover member 28, a body member 34 having a lower chamber 36 therein, an input port member 38, a output port member 40, a diaphragm means 42, a bias means 44, a valve seat 46 in said output port member 40 and a controlled orifice 48 in said input port member 38. The cross section illustrates that the idle speed control device 26 is fabricated from a plastic material, however, depending upon the location, the device may be fabricated from other materials such as metal. In some applications, the body may be integral with the carburetor or throttle body 14 and cast from the same material and the various ports are passageways formed therein. The cover 28 may be of the same or different material and the diaphragm 42, being rubber, may also serve as a seal between the cover member 28 and the body member 34 forming an upper chamber 50 in the cover member.

The first port 30 in the upper chamber 50 is connected by means of pneumatic tube 52 to the output port 54 of the control valve 20 and receives a vacuum control signal therefrom. The vacuum control signal is normally a higher pressure than found in the intake manifold 12 and operates with the bias means 44 to close the diaphragm 42 on the valve seat 46 and when the vacuum control signal is a lower pressure the diaphragm 42 is retracted limiting against a plurality of lands 56 formed by a plurality of radial slots 58 on the inside of the cover member 28. The lands 56 function to provide a space for the operation of the diaphragm 42 and to distribute the control signal on the upper surface of the diaphragm 42.

The input port member 38 in the lower chamber 36, normally connected to ambient air, has the controlled orifice 48 in one end for controlling the flow of air into the idle speed control device 26. In the preferred embodiment, the input port member 38 is typically a separate member in order that the idle speed control device 26 may be easily adapted to various engine displacements. The difference in several input port members is the size or cross-sectional area of the controlled orifice 48 as each engine displacement size may have a different sized controlled orifice 48. Once the engine displacement is known, the correct input port member 38 is sealingly connected to the body member 34. Therefore, it is by proper sizing of this orifice 48 that the device 26 is adaptable for various engine sizes.

The lower chamber 36 has as its input, ambient air from the input port member 38, and as its output, the valve seat 46 in the output port member 40 for connecting the device 26 to the source of intake manifold pressure. The valve seat 46 mates with the diaphragm 42 forming a valve means to control the flow of fluid from the controlled orifice 48 to the output port member 40. The bias means 44 biases the diaphragm 42 closing the valve means.

Figure 4:
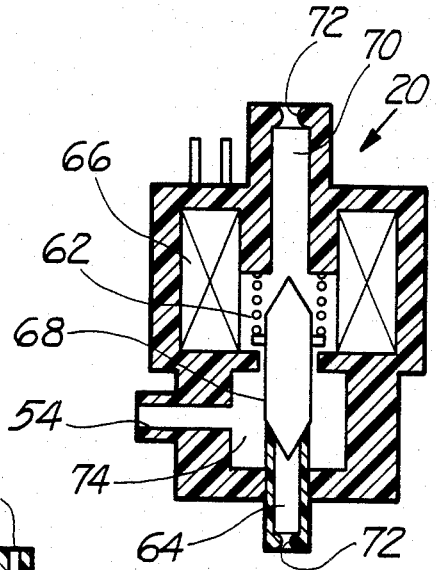
FIG. 4 is a sectional view of a control valve as may be used in FIG. 1.

Referring to FIG. 4, there is illustrated in cross-section a control valve or a three-way valve 20 which is normally biased by a spring 62 to close one input 64 which in the present embodiment is the intake manifold vacuum input that can be taken from a tube 60 connected to the second port 40. The control valve 20 is solenoid operated; receiving signals from an ECU 22 for energizing a solenoid 66 to move a plunger 68 between its normally closed position closing the one input 64 from the intake manifold to its actuated position which seals the second input 70 from the air cleaner 16. The output port 54 of the three-way valve is connected to the input port 30 of the idle speed control device 26 supplying control air pressure to the upper surface of the diaphragm 42 closing off the valve seat 46 in the output port member 40 of the idle speed control device 26. By means of electrical signals modulating the operation of the plunger 68, the desired pressure or vacuum level, ranging from ambient to intake manifold vacuum, is maintained in the lower chamber 36 during engine operation.

PRINCIPLE OF OPERATION

In the preferred embodiment, the idle speed control device 26 is operated by pneumatic forces which, in engine applications, tend to change quicker than other forces. More particularly, at idle conditions, the electrical supply system is typically lower than normal due to heavy turn-on power requirements of the engine and electric current build up is slow.

To understand the principle of operation, refer to the block diagram of the idle speed control system and consider the engine 10 turned off. At this particular condition, the intake manifold pressure and the pressure in the air cleaner 16 or the ambient air are substantially identical. Therefore, the fluid pressure at the first port 30 of the idle speed control device 26 is ambient and the diaphragm 42 is balanced closed on the valve seat 46 of the output port member 40 in the lower chamber 36.

Upon turning on the engine 10, the engine generates a vacuum in the intake manifold 12 during idle due to the fact that the throttle valve or choke valve which are not shown, are only partially open and the air drawn from the air cleaner 16 through the throttle body 14 and into the intake manifold 12 creates a large pressure drop across the throttle body 14. The vacuum is supplied to the one input 64 of the three-way valve 20 and to the output port member 40 of the idle speed control device 26. The ECU 22 through various sensors, senses the operating condition of the engine and determines that it is at idle speed and generates a signal to the control valve 20, which signal may be a digital word, causing the control valve solenoid 66 to actuate on a predetermined duty cycle.

When the control valve solenoid 66 is energized, the plunger 68 closes off the ambient air or second input 70 and opens the one input 64 such that the output of the control valve 20 is a pressure which is an intermediate pressure between ambient pressure and the intake manifold vacuum. The two inputs 64, 70 both contain orifices 72 creating a pressure drop thereacross during the short time that there is air flow through the valve 20. As the solenoid control valve solenoid 66 is energized and the plunger 68 moves to close the second input 70, the pressure in the inner chamber 74 of the control valve 20 will seek a pressure level due to the pressure drop across the orifices 72.

As the pressure in the inner chamber 74 of the control valve 20 drops, the pressure in the upper chamber 50 on the surface of the diaphragm 42 becomes less than the pressure in the lower chamber 36, therefore, the diaphragm 42 will start to lift off the valve seat 46. Once the valve seat 46 opens, air flows from the controlled orifice 48 into the lower chamber 36 and on into the intake manifold 12 continuing to lift the diaphragm 42. The controlled orifice 48 in the input port member 38 is a controlled pressure drop so that as the air flows into the lower chamber 36, a pressure drop is created across the controlled orifice 48 that eventually causes an equalization of the pressure in the lower chamber 36 with the pressure in the intake manifold 12 and the bias means 44 closes the diaphragm 42 against the valve seat 46. Once the valve seat is closed, there is no air flow from the controlled orifice 48 and, hence, no drop thereacross so that the pressure in the lower chamber 36 increases to ambient causing the diaphragm 42 to lift off the valve seat 46. This modulation of pressure also causes the diaphragm 42 to modulate.

As the control valve 20 is deenergized, ambient pressure is applied into the upper chamber 50. The pressure on the upper surface of the diaphragm 42 may overcome the pressure created by the flow of the air through the lower chamber 36 into the intake manifold 12 so that the diaphragm 42 seals on the valve seat 46. Thus, depending upon the operation of the control valve 20 by the ECU 22 at any given set of engine operating conditions the amount of bypass air supplied to the intake manifold 12 through the idle speed control device 26 is regulated at such a level as to provide the proper amount of air to mix with the fuel for combustion of the engine 10.

The idle speed control device 26 has a closed loop control system in that as the engine 10 decelerates from a high speed, the intake manifold pressure increases causing the idle speed control device 26 to open and close under the control of the control valve 20 and more particularly the pressure drop through the controlled orifice 48 in the input port member 38. When air flows through the controlled orifice 48 and into the output port member 40, the pressure drop across the controlled orifice 48 will cause the lower chamber 36 to equalize at the intake manifold pressure and the diaphragm 42 will close on the valve seat 46. With no air flow, the lower chamber 36 pressure moves toward ambient and the valve seat 46 will be opened. Thus, the diaphragm 42 will modulate and provide an amount of bypass air to properly mix with the fuel in the intake manifold 12.

The controlled orifice 48 in the input port member 38 is sized to provide desired peak air flow at a full signal or when the diaphragm 42 is off the valve seat 46. This peak air flow will cause the engine 10 to run at an upper speed level so that the control valve 20 can control the idle speed to a lower speed level.

Depending upon the application, the control valve 20 may be formed integrally with the idle speed control device 26 making a compact unit. In such a condition, the various input and output ports receiving the same fluid source may be interconnected. Such an embodiment 76 is illustrated in FIG. 6.

Figure 6:
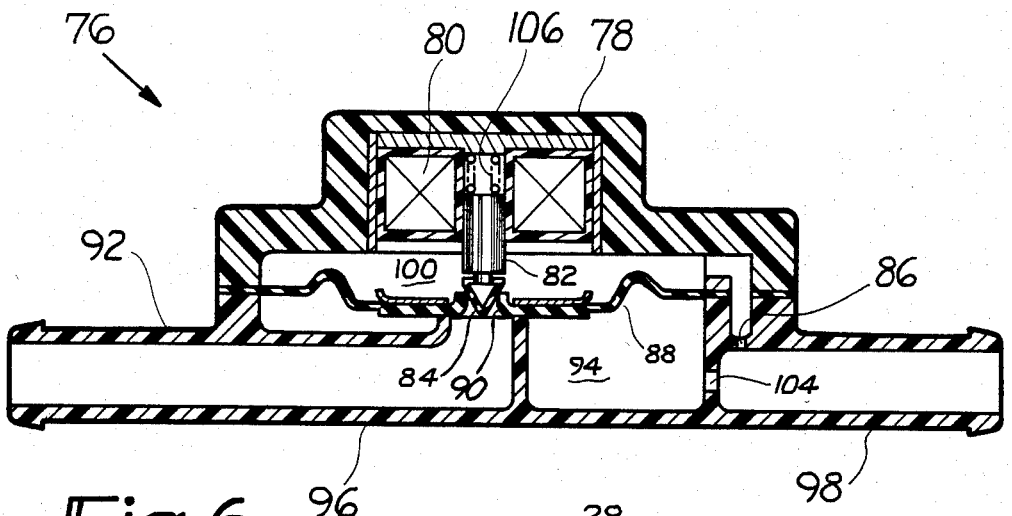
FIG. 6 is a sectional view of another embodiment of the vacuum operated idle speed control device.
Figure 5:
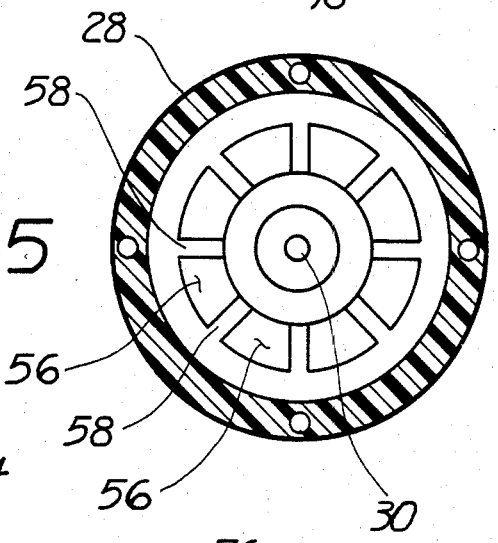
FIG. 5 is a sectional view with parts removed taken along line 5—5 of FIG. 3.

FIG. 6 is an alternate embodiment of the vacuum operated idle speed control device 76 wherein the control valve 20 and the idle speed control device 26 are an integral structure. The structure of FIG. 6 has a cover member 78, a solenoid 80, a valve means or plunger 82 having a conical shaped valve tip 84, a first port 86, a diaphragm 88, a valve seat 90 in the diaphragm, a body member 92, a lower chamber 94, an output port member 96 and an input port member 98.

The structure of FIG. 6 utilizes the input port member 98 to supply fluid pressure for both the upper chamber 100 and the lower chamber 94. The first port 86 is an orifice connected to the input port member 98 which during fluid flow develops a large pressure drop thereacross.

In the operation of the alternate embodiment 76, fluid flows in the input port member 98 and fills both the upper chamber 100 and lower chamber 94 with its pressure value. The solenoid 80 which is normally not energized has its plunger 82 extended and the valve tip 84 is seated in the valve seat 90 in the diaphragm 88. The output port member 96 encircles the valve seat 90 and is generally concentric therewith. The valve tip 84 on the valve means 82 is rubber or rubber coated to provide a good seal when mating with the valve seat 90.

Under control of an ECU 102, the solenoid 80 operates moving the valve tip 84 from the valve seat 90 causing a fluid flow from the upper chamber 100 to the output port member 96. When the pressure drop across the first port 86 in the input port member 98 causes the pressure in the upper chamber 100 and the pressure in the output port member 96 to equalize, the diaphragm 88 lifts off the output port member 96 causing fluid flow from the input port member 98, through the controlled orifice 104, the lower chamber 94 and into the output port member 96. If the solenoid 80 remains energized, the pressure on both sides of the diaphragm 88 will equalize.

When the solenoid 80 is deenergized, the bias means or spring 106 causes the plunger 82 to seat the valve tip 84 in the valve seat 90 terminating fluid flow from the upper chamber 100. As the plunger 82 extends, it operates to close the diaphragm 88 on the second port 84. The pressure in both the upper chamber 100 and the lower chamber 94 equalizes with the pressure at the first port 86 which is typically ambient pressure. The pressure at the output port member 96 is typically intake manifold, pressure; therefore, the diaphragm 88 is sealed on the output port member 96.

As in the embodiment 26 of FIG. 3, this embodiment 76 is typically manufactured in two pieces which may be either metal or plastic. The diaphragm 88 functions also to seal both pieces together and to divide the interior into the upper chamber 100 and the lower chamber 94. The controlled orifice 104 is sized for the particular engine displacement and by change of the size of this orifice 104, the device 76 can be used on any one of a family of engines in an engine range.

Figure 7:
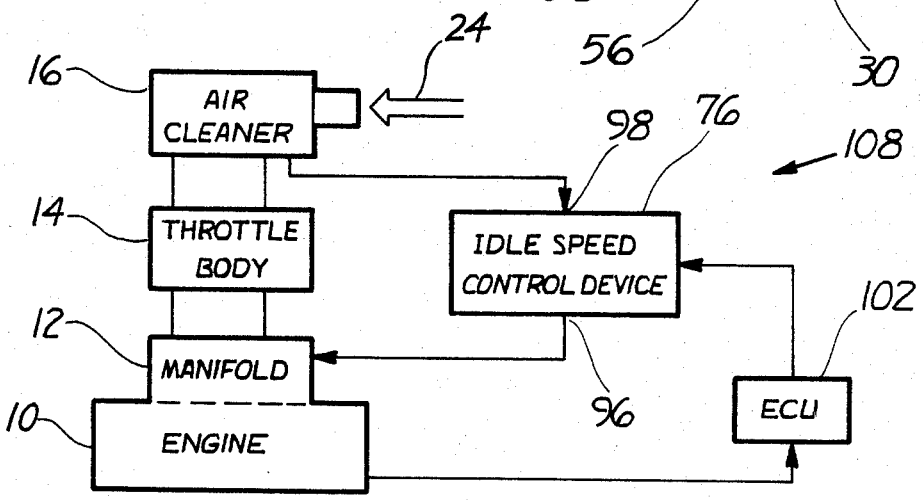
FIG. 7 is a block diagram of an idle speed control system using the embodiment of FIG. 6.

FIG. 7 is a block diagram of an idle speed control system 108 utilizing the embodiment 76 of FIG. 6. As in the preferred embodiment, this embodiment may also be integral with the throttle body or carburetor and the various ports will be formed as passageways therein.

There has thus been described in general, a vacuum operated idle speed control system, and more particularly a vacuum operated idle speed control device 26 which under control of a control valve 20 will respond to various engine operating conditions for providing a proper amount of bypass air into the intake manifold 12 of the engine 10. The idle speed control device 26 is a failsafe valve in that if it fails to operate, it will prevent the addition of air to the engine 10 eventually causing the engine 10 to slow down to such a speed that it will stall out.

I claim:

1. A vacuum operated idle speed control device for an internal combustion engine having an intake manifold, the device for supplying bypass air around the throttle blade in the throttle body and to the intake manifold to maintain engine idle speed at the lowest engine speed, the vacuum operated idle speed control device characterized by:

a housing;

a diaphragm dividing the interior of said housing into an upper chamber for receiving control pressure and a lower chamber;

an input port member for receiving bypass air in said lower chamber;

an output port member adapted to be connected to the intake manifold;

a valve means including a valve seat on said output member, said diaphragm operable to open and close said valve means; and a controlled orifice in said input port member having a size proportional to the displacement of the engine and operable to allow bypass air to flow therethrough to said output port member when the diaphragm opens the valve means and to provide a controlled pressure drop thereacross to equalize the pressure in said lower chamber with the intake manifold causing said diaphragm to close said valve means.

2. A vacuum operated idle speed control device for an internal combustion engine for providing bypass air to the intake manifold of the engine for maintaining the idle speed of the engine, the vacuum operated idle speed control device characterized by:

a housing having an upper chamber and a lower chamber;

a diaphragm having an orifice therein and interposed said upper and lower chambers;

a first port in said upper chamber receiving a control vacuum;

an input port member in said lower chamber receiving bypass air;

an output port member having a valve seat aligned with said orifice in said diaphragm for connection to the intake manifold;

a valve means in said upper chamber and operable in a first position to close said orifice and in a second position to open said orifice;

a solenoid means operable to move said valve means from said first position to said second position in response to various engine operating conditions; and a controlled orifice in said input member having a size proportional to the displacement of the engine, said size being operable to provide the amount of bypass air flow to maintain the idle speed of the engine at a speed greater than the stall speed when said orifice is open and to provide a pressure drop for equalizing the pressure in said lower chamber and the intake manifold closing said valve seat by said diaphragm.

3. A vacuum operated idle speed control device for an internal combustion engine comprising:

a body member having a chamber therein;

a cover member overlying said body member and having a first port adapted to receive a control pressure;

a diaphragm interposed said body member and said cover member for sealingly forming an upper chamber in said cover member with said first port and a lower chamber in said body member;

bias means in said upper chamber for biasing said diaphragm;

an output port member in said chamber adapted to be connected to a source of engine intake manifold pressure;

a valve seat connected to said output port member adapted to be closed by said diaphragm when the pressure in said upper chamber is greater than the pressure in said lower chamber;

an input port member in said lower chamber adapted to be connected to a fluid pressure source; and an orifice in said input port member operable in response to fluid flow therethrough to develop a pressure drop thereacross until the pressure in said lower chamber and the intake manifold pressure in the output port member are equal and lower than the pressure in said upper chamber for closing said diaphragm on said valve seat.

4. A vacuum operated idle speed control device for an internal combustion engine comprising:

a body member having a chamber therein;

a cover member overlying said chamber, said cover having a first port adapted to receive a control pressure;

a diaphragm interposed for sealing said body member and said cover member forming an upper chamber with said first port in said cover member and a lower chamber in said body member, said diaphragm having an orifice therein for allowing fluid flow from said upper chamber;

valve means in said upper chamber and operable in a first position to close said orifice in said diaphragm and in a second position to open said orifice;

an output port member in said lower chamber adapted to be connected to a source of engine intake manifold pressure;

a valve seat connected in said output port member and aligned with and encircling said orifice in said diaphragm, said valve seat adapted to be closed when said valve means is in said first position and the pressure in said upper chamber is greater than the pressure in said lower chamber;

an input port member in said lower chamber adapted to be connected to a fluid pressure source;

a controlled orifice in said input port member operable in response to fluid flow therethrough to develop a pressure drop thereacross when said valve seat is open; and solenoid means operable to move said valve means from said first position to said second position in response to various engine operating conditions allowing fluid flow from said upper chamber and said lower chamber through said output port member.

* * * * *